US005088453A

United States Patent [19]

Kleineberg et al.

[11] Patent Number: 5,088,453

[45] Date of Patent: Feb. 18, 1992

[54] DELIVERY VALVE UNIT ON A COMPENSATING TANK

[75] Inventors: Wolfgang Kleineberg, Calw; Hans Schaal, Esslingen; Thomas Attinger, Stuttgart, all of Fed. Rep. of Germany

[73] Assignee: Mercedes-Benz AG, Fed. Rep. of Germany

[21] Appl. No.: 697,435

[22] Filed: May 9, 1991

[30] Foreign Application Priority Data

Jun. 29, 1990 [DE] Fed. Rep. of Germany ..... 4020866

[51] Int. Cl.[5] ..... F01P 3/22

[52] U.S. Cl. ..... 123/41.54; 123/41.03

[58] Field of Search ..... 123/41.03, 41.27, 41.54; 137/454.2, 587; 165/104.32

[56] References Cited

U.S. PATENT DOCUMENTS 3,700,166 10/1972 Foults ..... 123/41.54

4,640,235 2/1987 Martin ..... 123/41.27

FOREIGN PATENT DOCUMENTS 0180206 10/1985 European Pat. Off. .

*Primary Examiner*—Noah P. Kamen

*Attorney, Agent, or Firm*—Evenson, Wands, Edwards, Lenahan and McKeown

[57] ABSTRACT

A delivery-valve unit is provided on a compensating tank in the cooling circuit of an internal-combustion engine. Individual relief valves inside a receiving housing arranged horizontally in a cover of the compensating tank are additionally surrounded by valve housings which are snapped together. The sealing surfaces of the relief valves are uncoupled from the walls of the compensating tank. In the event of dimensional changes in the compensating tank, this arrangement prevents both deformations of the sealing surfaces occurring as a result of a water-level-induced pressure rise and leaks at the relief valves.

16 Claims, 1 Drawing Sheet

DELIVERY VALVE UNIT ON A COMPENSATING TANK

BACKGROUND AND SUMMARY OF THE INVENTION

The present invention relates to a delivery-valve unit on a compensating tank in the cooling circuit of an internal-combustion engine and, more particularly, to a valve unit which is inserted in a receiving housing arranged within the tank cover and consists of a first relief valve and a second relief valve, following the first relief valve. The valves each consist of a valve body closing a valve orifice by a spring and a float controlling an overflow bore located between the two relief valves.

A conventional delivery-valve unit is shown in EPA 0,180,208. The disadvantage of this arrangement of a delivery-valve unit on a compensating tank is, however, that the valve unit bulges together with the tank in the event of a pressure rise in the tank such that the valve sealing surfaces subjected to pressure on one side become distorted and leaks occur.

An object of the present invention is to provide a delivery-valve unit in which leaks brought about by dimensional changes in the compensating tank are avoided.

In accordance with the present invention, the foregoing object has been achieved by arranging the relief valves in valve housings which are separate from the compensating tank and which are inserted sealingly in a receiving housing. Two valve orifices are connected to the tank interior via respective overflow bores separated from one another. A float for controlling the overflow bore located between the relief valves is guided in the tank interior.

Thus, the provision of special valve housings affords new sealing surfaces for the relief valves in those valve housings, thereby doing away with the previous sealing surfaces of the valves relative to the compensating tank. Because the sealing surfaces of the valve unit are uncoupled from the walls of the compensating tank, the sealing surfaces remain undisturbed by pressure stress in the event of a dimensional change in the compensating tank.

A further advantage of the present invention is provided by the feature in which the valve-receiving housing is horizontally arranged, enclosing the two valve housings together with the valves, on the cover of the compensating tank, since, contrary to known configurations, space is saved in the upper part of the engine compartment.

An additional advantageous arrangement of a delivery-valve unit of the present arrangement resides in a rib extending longitudinally or transversely in the tank cover and forming the termination of an intermediate wall inside the tank with the cover ensures greater stability of the valve unit and greater protection of the valve elements. Under pressure stresses in the tank, the intermediate wall acts in the manner of a tie rod for the cover.

Another advantageous feature of the valve unit according to the present invention is a connection of the two valve housings by way of a snap engagement which makes handling easier during the coupling of valve housings.

Finally, the use of O-ring gaskets in the arrangement of the present invention guarantees adherence to distortion tolerances as regards leakproofing and constitutes a costeffective sealing alternative.

BRIEF DESCRIPTION OF THE DRAWINGS

These and other objects, features and advantages of the present invention will become more apparent from the following detailed description of presently preferred embodiments when taken in conjunction with the accompanying drawings wherein.

DETAILED DESCRIPTION OF THE DRAWINGS

Figure 1:
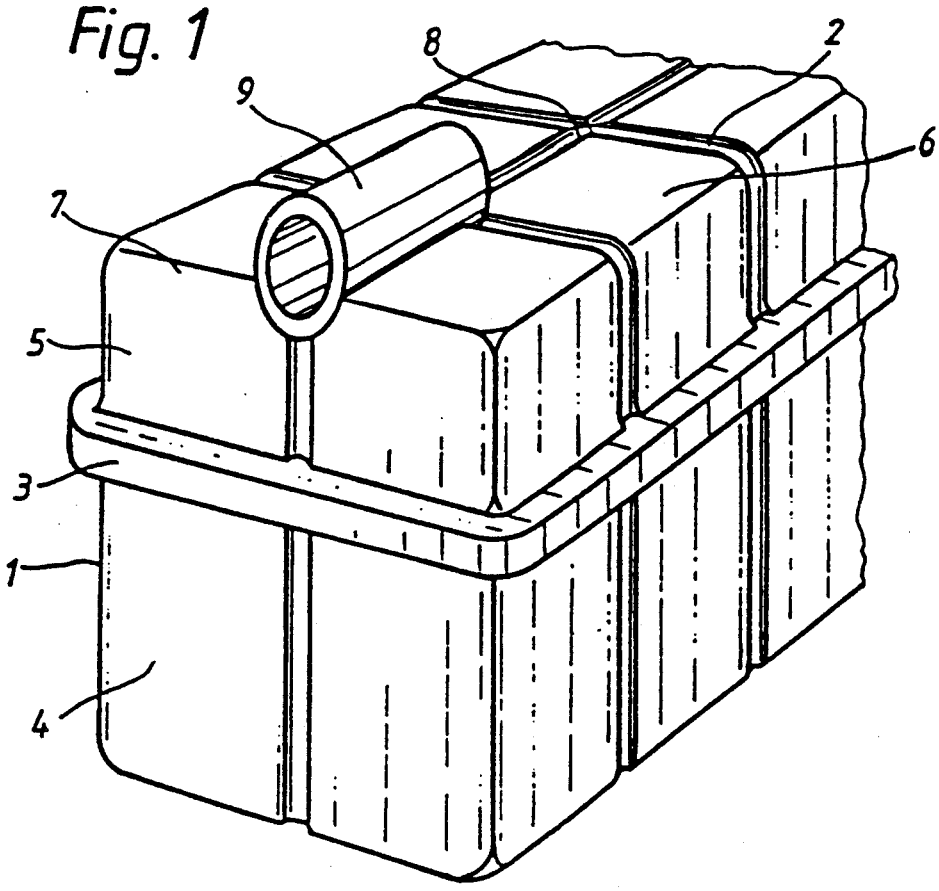
FIG. 1 is a partial, half-profile perspective view of a compensating tank with a delivery-valve unit inserted in a rib of the cover.

FIG. 1 shows part of a compensating tank 1 having, on its surface, longitudinally and transversely extending ribs 2 which form the termination of intermediate walls (not shown in detail) inside the tank 1 relative to the tank body. The tank body possesses a welding bead 3 all the way around which indicates the connection of a lower part 4 to an upper part 5 of the tank body. In the cover 6 of the upper part 5 of the tank body, a tubular receiving housing 9 for a delivery-valve unit is fastened horizontally in the region of a cover edge 7 along a longitudinal rib 8.

Figure 2:
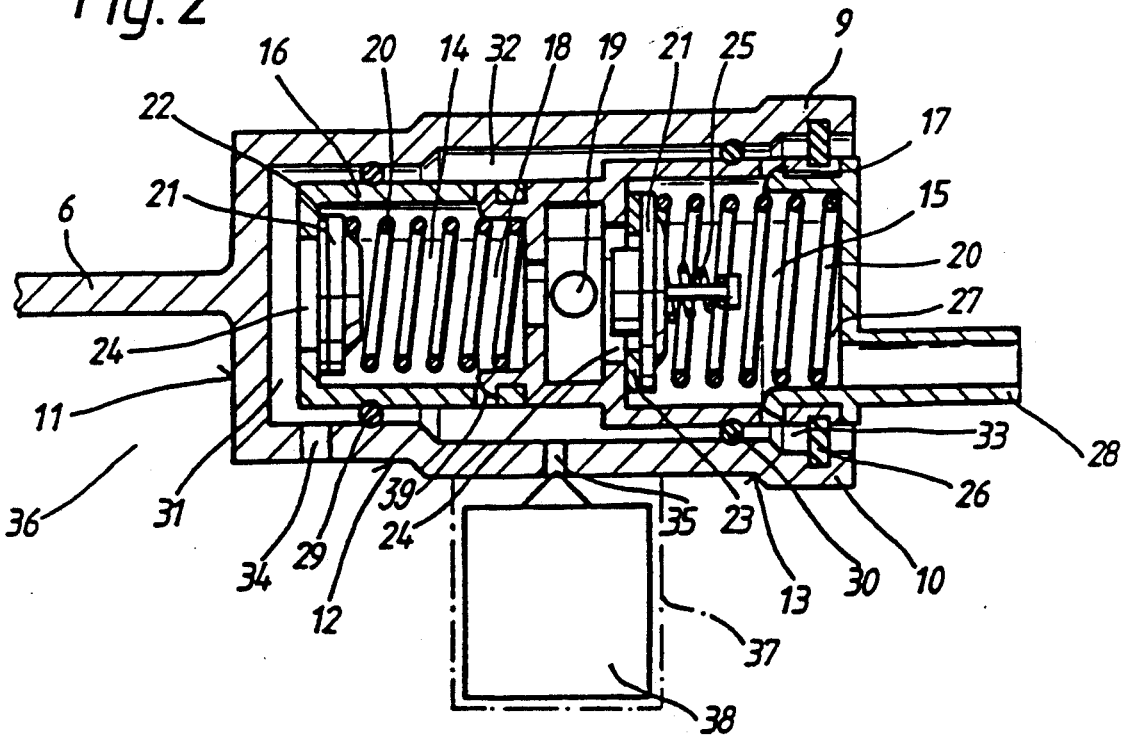
FIG. 2 is a partial longitudinal sectional view through a receiving housing with a delivery-valve unit in the cover of a compensating tank according to the present invention.

FIG. 2 illustrates a portion of the upper cover 6 of a compensating tank 1 in which the receiving housing 9 is mounted horizontally. An underside 10 of the receiving housing forms part of the upper cover 6. The receiving housing 9 has an end wall 11 arranged vertically and centrally in relation to the cover and widens symmetrically in two steps 12, 13. Inside the receiving housing 9 are located two relief valves 14, 15 in valve housings 16, 17. An outlet side 18 of the first valve housing 16 is snapped together with an inlet side 19 of the second valve housing 17 by snap elements 39.

The opening direction of the relief valves 14, 15 is in the widening direction of the receiving housing. The relief valves 14, 15 each consist of a helical spring 20 and a valve body 21 which is pressed by the helical spring 20 onto sealing surfaces 22, 23 of the respective valve housings 16, 17 to close the valve orifice 24 located on the inlet side.

The second valve housing 17 additionally contains an underpressure valve 25. A spring ring or lid 26 is inserted in the orifice region of the receiving housing 9 as a valve-unit retention mechanism which surrounds the delivery-valve unit consisting of the first relief valve 14 and of the second relief valve 15 together with their associated housing 16, 17. This can take place via a snap connection, a screw thread, a bayonet fastening, or any other conventional connecting techniques. Furthermore, an outlet side 27 of the second relief valve 15 is snapped together with an overspill attachment 28 which is located in the region of the underside 10 of the receiving housing 9. The valve housings 16, 17 are each sealed off and supported relative to the receiving housing 9 in front of the first step 12 and in front of the second step 13 by respective O-rings 29, 30. The interior of the receiving housing 9 is thereby divided into three spaces 31, 32, 33. On the underside 10 of the receiving housing 9, overflow bores 34, 35 leading to the interior 36 of the compensating tank 1 are located, respectively, in the spaces 31 and 32. A cage 37 (shown only schematically) is fastened around the overflow bore 35 on the underside 10 of the compensating tank 1 from the interior of the latter. The cage 37 contains a float 38 which closes the overflow bore 35 beyond a specific fluid level in the compensating tank 1, such that the valve unit is then subjected to pressure solely via the overflow bore 34.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A delivery-valve unit arrangement on a compensating tank in the cooling circuit of an internal-combustion engine, comprising a receiving housing arranged within a cover of the tank and in which the delivery valve unit is inserted, a first relief valve, and a second relief valve following the first relief valve in a downstream direction, each of the relief valves having a spring associated with a valve body for closing valve orifices and a float controlling a first overflow bore located between the two relief valves, wherein the relief valves are provided in valve housings separate from the compensating tank and inserted sealingly in the receiving housing, and valve orifices being operatively connected to an interior portion of the tank via the first overflow bore and a second overflow bore, wherein the float is located between the relief valves and is guided in the interior portion of the tank.

2. The arrangement according to claim 1, wherein the receiving housing is located in a top wall of the cover of the compensating tank, and the second bore communicating with only the first of the valves.

3. The arrangement according to claim 1, wherein a respective O-ring seals off each of the valve housings relative to the receiving housing, and one of the O-rings is arranged between the first overflow bore and the second overflow bore and another of the O-rings is arranged between the second overflow bore and a valve-unit retention means located in an orifice region of the receiving housing, the O-rings also dividing the interior of the receiving housing into two spaces.

4. The arrangement according to claim 3, wherein the receiving housing is located in a top wall of cover of the compensating tank, and the second bore communicating with only the first of the valves.

5. The arrangement according to claim 1, wherein the receiving housing is arranged along a horizontally extending rib in a top wall of the cover of the compensating tank

6. The arrangement according to claim 5, wherein the receiving housing is located in a top wall of compensating tank, and the second bore communicating with only the first of the valves.

7. The arrangement according to claim 6, wherein a respective O-ring seals off each of the valve housings relative to the receiving housing, and one of the O-rings is arranged between the first overflow bore and the second overflow bore and another of the O-rings is arranged between the second overflow bore and a valve-unit retention means located in an orifice region of the receiving housing, the O-rings also dividing the interior of the receiving housing into two spaces.

8. The arrangement according to claim 1, wherein snap engagement means connect the housing of the first valve to the housing of the second valve.

9. The arrangement according to claim 8, wherein the receiving housing is located in a top wall of the cover of the compensating tank, and the second bore communicating with only the first of the valves.

10. The arrangement according to claim 9, wherein a respective O-ring seals off each of the valve housings relative to the receiving housing, and one of the O-rings is arranged between the first overflow bore and the second overflow bore and another of the O-rings is arranged, between the second overflow bore and a valve-unit retention means located in an orifice region of the receiving housing, the O-rings also dividing the interior of the receiving housing into two spaces.

11. The arrangement according to claim 10 wherein the receiving housing is arranged along a horizontally extending rib in a top wall of the cover of the compensating tank.

12. The arrangement according to claim 1, wherein the float is guided in a cage fastened to an underside portion of the receiving housing.

13. The arrangement according to claim 12, wherein the receiving housing is location in a top wall of the cover of the compensating tank, and the second bore communicating with only the first of the valves.

14. The arrangement according to claim 13, wherein a respective O-ring seals off each of the valve housings relative to the receiving housing, and one of the O-rings is arranged between the first overflow bore and the second overflow bore and another of the O-rings is arranged between the second overflow bore and a valve-unit retention means located in an orifice region of the receiving housing, the O-rings also dividing the interior of the receiving housing into two spaces.

15. The arrangement according to claim 14, wherein the receiving housing is arranged along a horizontally extending rib extending one of longitudinally and transversely in the cover of the compensating tank.

16. The arrangement according to claim 15, wherein snap engagement means connect the housing of the first valve to the housing of the second valve.

* * * * *